United States Patent [19]

Magnuson

[11] Patent Number: 4,567,693

[45] Date of Patent: Feb. 4, 1986

[54] MICROTOME KNIFE SHARPENING INSTRUMENT

[76] Inventor: Victor E. Magnuson, 1818 Linden Ave., Mishawaka, Ind. 46544

[21] Appl. No.: 543,851

[22] Filed: Oct. 20, 1983

[51] Int. Cl.[4] ..... B24B 9/00

[52] U.S. Cl. ..... 51/3; 51/65; 51/109 BS; 76/81.7; 76/82

[58] Field of Search ..... 76/81, 81.7, 82, 82.2, 76/85, DIG. 9; 51/3, 5 R, 64, 65, 59 R, 181 R, 109 BS, 159, 158

[56] References Cited

U.S. PATENT DOCUMENTS

| | | | |
|---|---|---|---|
| 945,137 | 1/1910 | Olds | 51/59 R |
| 950,284 | 2/1910 | Green . | |
| 1,001,735 | 8/1911 | Denison | 51/65 |
| 1,180,413 | 4/1916 | Munson | 51/109 BS |
| 2,511,449 | 6/1950 | Springman | 51/122 |
| 2,540,443 | 2/1951 | Harris . | |
| 2,741,881 | 4/1956 | Falls . | |
| 3,576,089 | 4/1971 | Magnuson . | |
| 3,844,067 | 10/1974 | Guerra et al. | 51/58 |
| 3,874,120 | 4/1975 | Dalton et al. | 51/59 R |
| 3,875,702 | 4/1975 | Yacos | 51/159 |
| 3,977,127 | 8/1976 | Mahnken | 51/5 R |
| 3,981,105 | 9/1976 | Flaherty et al. . | |
| 4,052,174 | 10/1977 | Grat | 51/81 BS |
| 4,092,805 | 6/1978 | Williams | 76/81.7 |

FOREIGN PATENT DOCUMENTS 285549 12/1952 Switzerland .

*Primary Examiner*—James G. Smith
*Assistant Examiner*—Robert A. Rose
*Attorney, Agent, or Firm*—Marmaduke A. Hobbs

[57] ABSTRACT

An instrument for sharpening microtome knives and similar articles, having a honing mechanism and a deburring or stropping mechanism, arranged on a housing which encloses motors for driving the mechanisms. The knife is honed against a stone, which is mounted on a reciprocating carriage that has a variable speed control, and the honed knife blade is then deburred or stropped using a pair of counter-rotating disks, one for each side of the knife blade. A vise securely holds the knife and positions it at the proper angle for optimum honing, and the vise is mounted in a track which allows the knife blade to be moved back and forth across the reciprocating hone for uniform honing. A shield guards against inadvertent contact with the dangerously sharp blades during the honing operation, and guards are used to prevent the vise from leaving the track.

15 Claims, 8 Drawing Figures

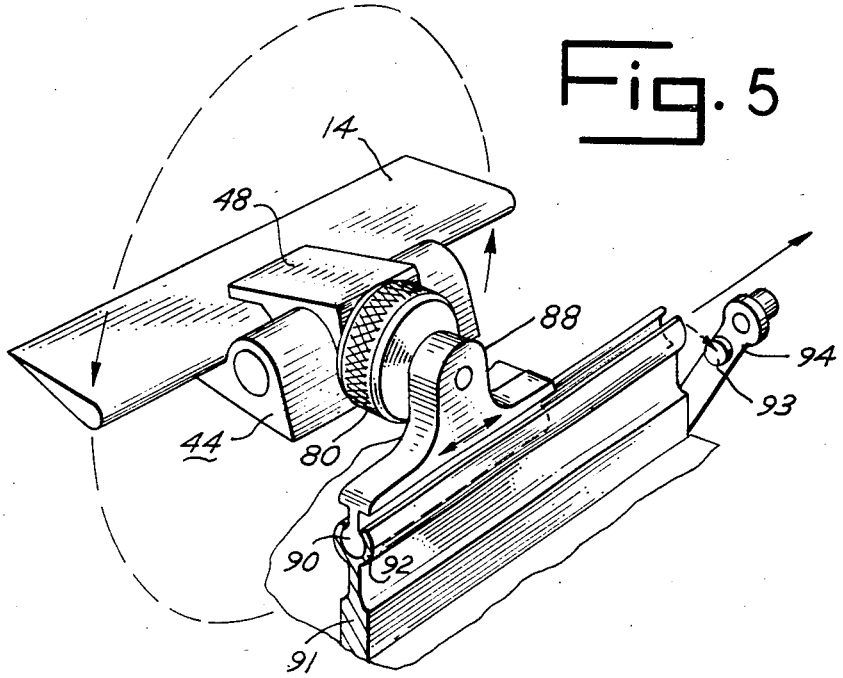
Fig. 5
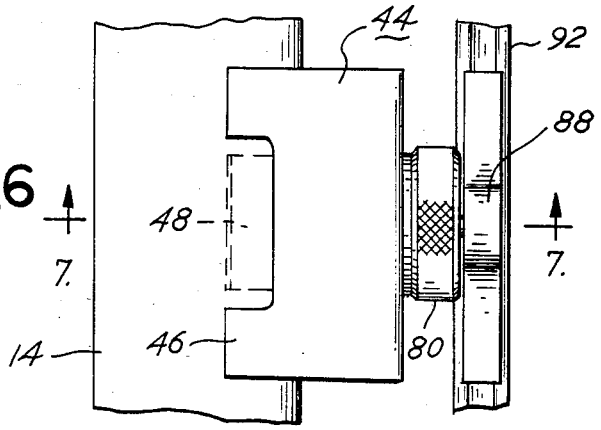
Fig. 6
Fig. 8
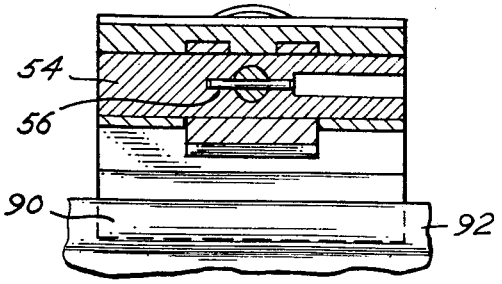
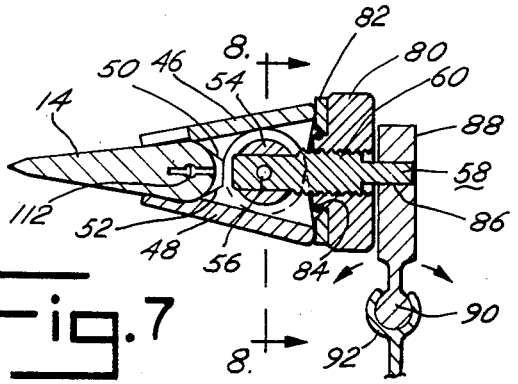
Fig. 7

MICROTOME KNIFE SHARPENING INSTRUMENT

BACKGROUND OF THE INVENTION

A microtome is an instrument used for cutting samples of organic tissue into thin sections for microscopic examination of the sections. The branch of science is called histology, and the cutting operation is performed by histotechnologists. In general, the subject tissue to be examined is encased in paraffin and clamped into place in the microtome. The sample is then either moved back and forth against the cutting edge of a microtome knife or the knife is drawn across the surface of the sample. The thickness of the section is dependent upon the particular purpose of the examination, and a very detailed study of delicate tissues may require a section with a thickness of only two millimeters, although five millimeter sections are more common. With such minute section thicknesses, and the critical nature of the studies performed by the histotechnologists, the cutting edge of the microtome knife must be extremely sharp. Knife edges which are not substantially perfect will result in tissue sections which are deformed or torn and, as a result, generally unsuitable for proper studies and diagnoses. Since every tissue sample is unique and a substitute sample may not be obtainable, the proper surgical precision must be maintained. The edges of the microtome knives must be frequently honed and deburred or stropped, the frequency dependent upon the nature of the tissue sample being sectioned, and the knives must occasionally be reground or reconditioned.

Due to the sharpness of the cutting edges required by the nature of the science, microtome knives are also very dangerous instruments which must be handled as little as possible and with the utmost care and respect. Currently, devices are available into which the knives are inserted, and in which the sharpening operation is performed automatically. These devices provide safety for the technician during the actual sharpening operation; however, the danger is still present during insertion and removal of the knife, the devices are very expensive to buy and maintain, and the sharpening operation may require an hour or longer. Thus, if sectioning bone samples, for example, which may require that the knife edge be honed several times a day, the sharpening or honing operation becomes a very costly procedure in terms of equipment and the technician's time, and in many cases, a costly knife inventory must be maintained.

A device which performs an instrument sharpening operation is disclosed in my U.S. Pat. No. 3,576,089, issued on Apr. 27, 1971, for a Honing and Sharpening Machine which uses a rapidly reciprocating hone for sharpening instruments and tools that are mainly used by dentists and surgeons. Another device used for polishing the cutting edge or tip of surgical instruments is disclosed in my pending application for a Polishing Machine for Cutting Instruments and Tools, Ser. No. 383,536, filed on June 1, 1982.

SUMMARY OF THE INVENTION

It is, therefore, one of the principal objects of the present invention to provide an instrument for sharpening microtome knives and similar articles, in which the sharpening operation is quickly and easily performed, requiring only a short time for the entire honing and deburring or stropping operation, and which restores the required, critically sharp edge to the knife.

Another object of the present invention is to provide an instrument for sharpening microtome knives in which the knife need never be directly handled during the sharpening operation, thereby helping to ensure the safety of the technician, and which removes a minimal amount of metal from the surface of the knife, thus increasing the life of the microtome knife.

A futher object of the present invention is to provide a sharpening instrument which can be conveniently used in an office or laboratory without the need for special installation or service, which can be easily moved from place to place as required by the histotechnologists, and which is easily stored when not in use.

A still further object of the present invention is to provide a sharpening instrument which requires very little specialized training for the technician in its proper use, and which is designed to anticipate and eliminate the common mistakes made by technicians who must use the dangerously sharp microtome knives daily.

These and other objects are attained by the present invention, which relates to an instrument for sharpening microtome knives and similar articles in which the honing and deburring mechanisms are conveniently and compactly arranged in a single unit. The instrument has a reciprocating carriage member with a hone mounted thereon for honing the knife blade, and a pair of counter-rotating deburring or stropping disks, one for each side of the blade, for final polishing of the blade. Motor means are provided for operating the hone and the disks, and a clamping means holds the knife blade against the hone for the initial sharpening step. The clamped knife is mounted in a holder which allows the knife blade to be moved back and forth across the reciprocating hone to assure uniform honing. The entire honing and deburring operation can be accomplished in a few minutes and restores the critically sharp knife edges, which are necessary to the successful use of the microtome due to the nature of the delicate tissue samples which must be sectioned.

Various other objects and advantages will become apparent from the following description, reference being made to the accompanying drawings.

BRIEF DESCRIPTION OF THE DRAWINGS

FIG. 5 is a fragmentary, perspective view of the knife blade, the clamp for the blade and the clamp mount, the arrows indicating the motions of rotating the knife 180° to hone the opposite side, the removal of the clamp from the holder, and the pivotable side guards for the holder;

FIG. 6 is a fragmentary, top plan view of the clamp and the knife blade;

FIG. 7 is a cross-sectional view illustrating the position of the knife in the clamp and the clamp in its mount, the section being taken on line 7—7 of FIG. 6; and FIG. 8 is a partial cross-sectional view of the clamp for the mcirotome knife, the section being taken on line 8—8 of FIG. 7.

DETAILED DESCRIPTION OF THE PREFERRED EMBODIMENT

Figure 1:
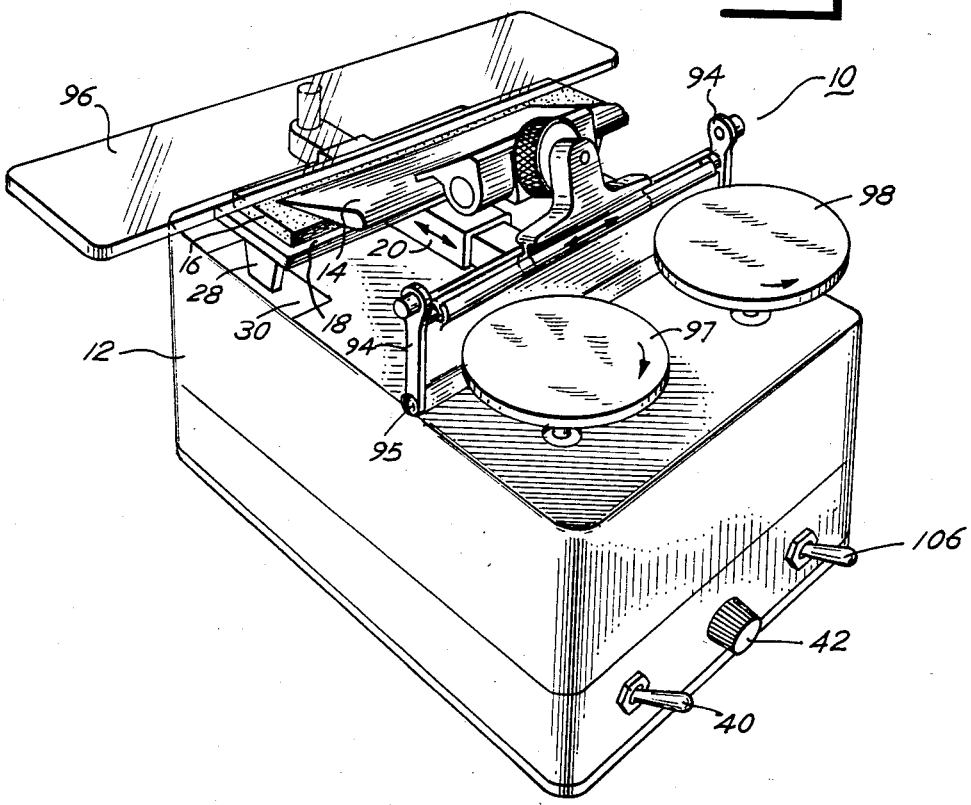
FIG. 1 is a perspective view of the present instrument for sharpening microtome knives and similar articles, illustrating the convenient and compact assembly with a microtome knife clamped into place for the honing step, and the deburring or stropping disks adjacent the clamp mount.
Figure 4:
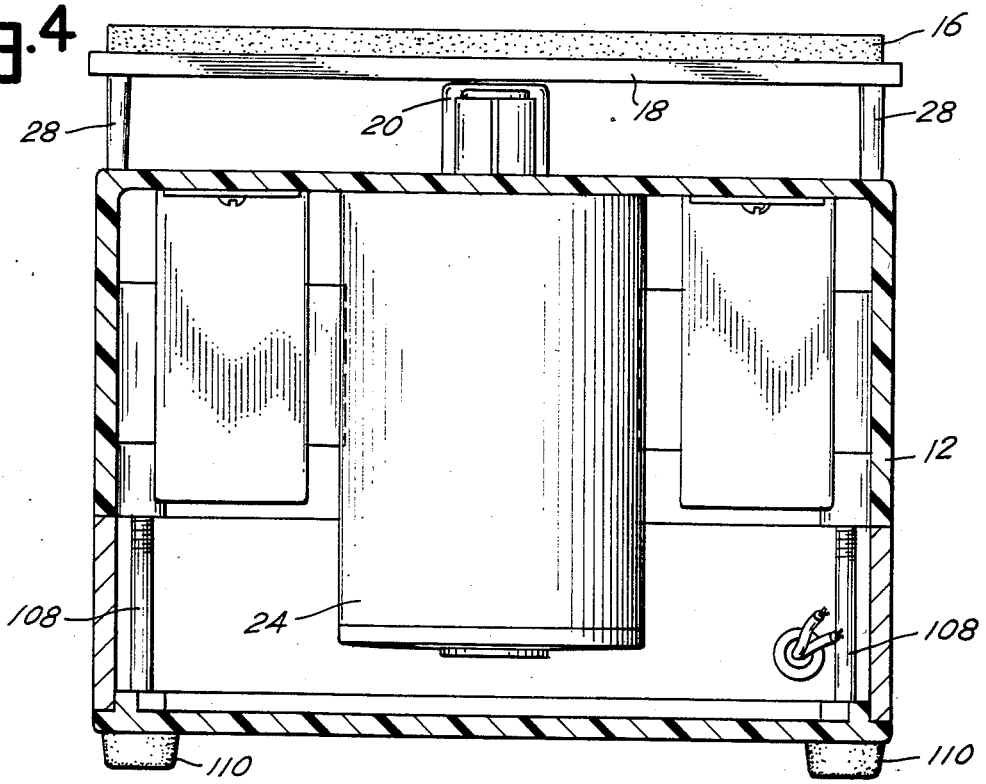
FIG. 4 is an enlarged cross-sectional view illustrating the motor for the reciprocating carriage member, with the controls being shown in box form, the section being taken on line 4—4 of FIG. 2.

Referring more specifically to the drawings, and to FIG. 1 in particular, numeral 10 designates generally the instrument for sharpening microtome knives and similar articles. The instrument has been designed to perform the honing and stropping operations on microtome knives, which are necessary to maintain the critically sharp edge required for organic tissue sectioning. The unit is portable and the components are compactly arranged on a housing 12, making the present invention suitable for use in laboratories or offices, where it requires minimal space and is easily stored when not in use. The initial sharpening step for the microtome knife 14 shown here is accomplished by a reciprocating honing means such as hone 16, which may be of any sutiable honing material, for example, aluminum oxide abrasive. The hone is secured to the top surface of a platform 18, the platform being suitably and removably mounted on a reciprocating carriage member 20. The carriage is disposed over and parallel with a reciprocating support member 22, which is mounted on housing 12. The carriage and member 22 are driven by a suitable motor means, such as motor 24, shown in FIG. 4, by means of a shaft which extends upwardly from motor 24, into support member 22, thereby reciprocating the support member and carriage as the motor shaft rotates, the carriage reciprocating in the directions indicated by the arrow on the carriage in FIG. 1. The details of the mechanism, whereby the platform 18 and carriage 20 are driven by the motor, are disclosed in my prior U.S. Pat. No. 3,576,089, the relevant disclosure of which is incorporated herein by reference. The platform 18 and its attached hone 16 are mounted perpendicular to the carriage and support member, enabling the hone to contact the entire edge of knife 14 as the honing proceeds. Each end of platform 18 is supported by legs 28, which extend downwardly from the platform to lightly contact virtually frictionless pads 30 which are mounted on housing 12, the legs assuring a level surface on which to hone the knife.

Motor 24 is controlled by a suitable means such as on-off switch 40, and the speed of the motor, and hence the reciprocation, can be adjusted using a speed control handle or knob 42. The adjustability of the honing speed makes the present instrument suitable for handling all types of honing operations, from coarse to extremely fine honing, depending on the type and condition of the particular knife blade. The speed control knob also has an off position for the convenience of the technician. Details of the circuitry and control means for the reciprocating carriage can be obtained by reference to my aforementioned U.S. Pat. No. 3,576,089.

Even when the microtome knives are in need of sharpening, they are dangerously sharp and should be handled as little as possible. Thus, the present instrument has been designed in such a manner that the knife need never be touched by the technician or histotechnologist. A clamping means such as vise 44, detailed in FIGS. 5 through 8, can be secured to the back of the knife while the blade is encased in a safety holder or sheath (not shown), which is generally provided with each knife. The vise has an upper, two-pronged jaw 46 and a lower, single-pronged jaw 48, providing three-point stability for securely gripping the knife. Cooperating bevels 50 and 52, on the inner surfaces of jaws 46 and 48, respectively, act to position the knife within the vise at an appropriate angle for honing. The jaws are pivotally mounted around shaft 54 and secured thereto by means such as pin 56, which is inserted through, and also secures, rod 58. Rod 58 has a threaded portion at 60 on which a tightening means, such as wheel 80, is threadedly mounted. Adjacent wheel 80 is a washer 82, secured around the neck portion of wheel 80 by a fastener such as snap ring 84. The washer is slidably mounted and helps to close the jaws, thereby securing the knife. The wheel is rotated counter-clockwise, as viewed in FIG. 5, to open jaws 46 and 48, whereupon they can be positioned around the back surface of knife 14. The wheel is then rotated clockwise to secure the knife. Rod 58 has an unthreaded portion at 86 seated in a hole in a slidable and tiltable support 88 which has a rounded base portion 90 designed for insertion into a raised mounting means such as track means 91. The upper portion of the track means is formed as a semicircular track 92 for pivotally receiving base 90 of support 88, as indicated by the arrows in FIG. 7. The support is designed for sliding movement in the track, as indicated by the arrow on the collar in FIGS. 1 and 5. Thus, as the honing operation proceeds and the knife contacts the reciprocating hone, support 88 can be slid back and forth, assuring uniform honing. When one side of the knife has been honed, the collar is pivoted away from the hone, thereby raising the knife, and the vise 44 and knife are rotated endwise 180° in either direction, as indicated by the circular arrows in FIG. 5. This places the opposite side of the knife in position for honing, and support 88 is then pivoted towards the hone. Pivotable guard means 94 are mounted at each end of the base of track means 91, secured thereon by a suitable means, such as screws 95. The guards extend upwardly to block the ends of track 92 for selectively preventing the collar from leaving the track during the honing operations, thereby helping to ensure the safety of the technician. A further safety means is provided in the form of shield 96, which is removably mounted near the outer end of support member 22 for extension over the edge of the knife blade during honing.

Upon completion of the honing operation, the knife must be deburred or stropped to achieve the desired edge, using a deburring or stropping means in the form of a pair of counter-rotating disks 97 and 98. The disks are normally composed of leather or leather-like material and are secured to disk support members 99 and 100, respectively. The disk supports are mounted on counter-rotating parallel shafts 101 and 102 which extend upwardly from the motors 103 and 104 of motor means 105, the motors are mounted within housing 12 and, in the embodiment shown here, two motors are provided; however, an embodiment having one motor, with gearing or belts designed to provide the counter-rotation desired, is intended to be included within the scope of the present invention. The motors are controlled by a means such as switch 106. Further details on the control circuitry for the motor means 105 are disclosed in my aforementioned pending application, Ser. No. 383,536, for a Polishing Machine for Cutting Instruments and Tools, filed on June 1, 1982, the disclosure of which is incorporated herein by reference. Access to the motors and the control circuitry can be obtained by removing bolts 108, which secure the two halves of the housing together and also secure rubber feet 110 to the bottom of housing 12 for minimizing vibration.

In the use and operation of the present instrument for sharpening microtome knives and similar articles, the instrument 10 is positioned in a convenient place in the laboratory or office and the power cord (not shown) is connected to an appropriate electrical outlet. The jaws, 46 and 48, of the clamping means or vise 44 are placed around the approximate center of the back of the microtome knife 14, and wheel 80 is tightened to secure the knife within the jaws. The rounded base 90 of suppport 88 is then inserted into the semicircular track 92. Once the vise has been inserted, the guards 94 are pivoted upwardly, thereby blocking the ends of track 92 and securing the vise therein. The vise is then pivoted downwardly, bringing the edge of the knife blade into contact with hone 16. Shield 96 is then mounted on the carriage support member 22 to prevent any inadvertent contact with the knife during the honing operation.

Figure 2:
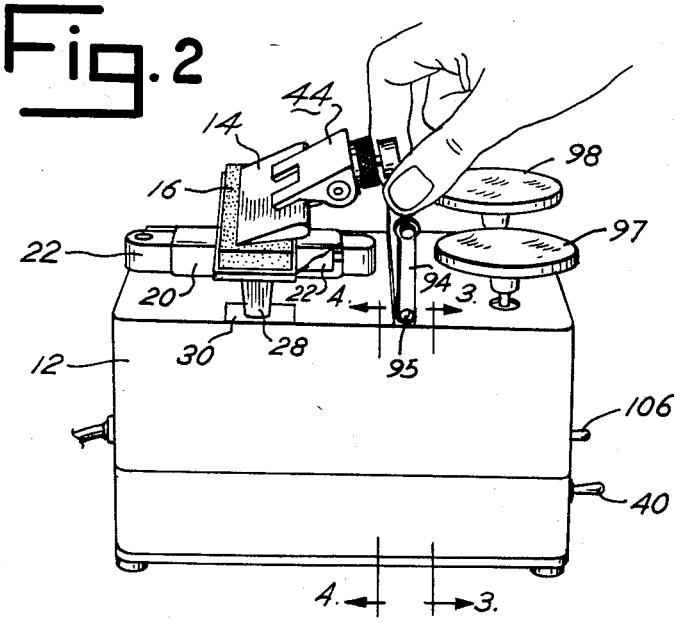
FIG. 2 is a perspective view illustrating the honing procedure.
Figure 3:
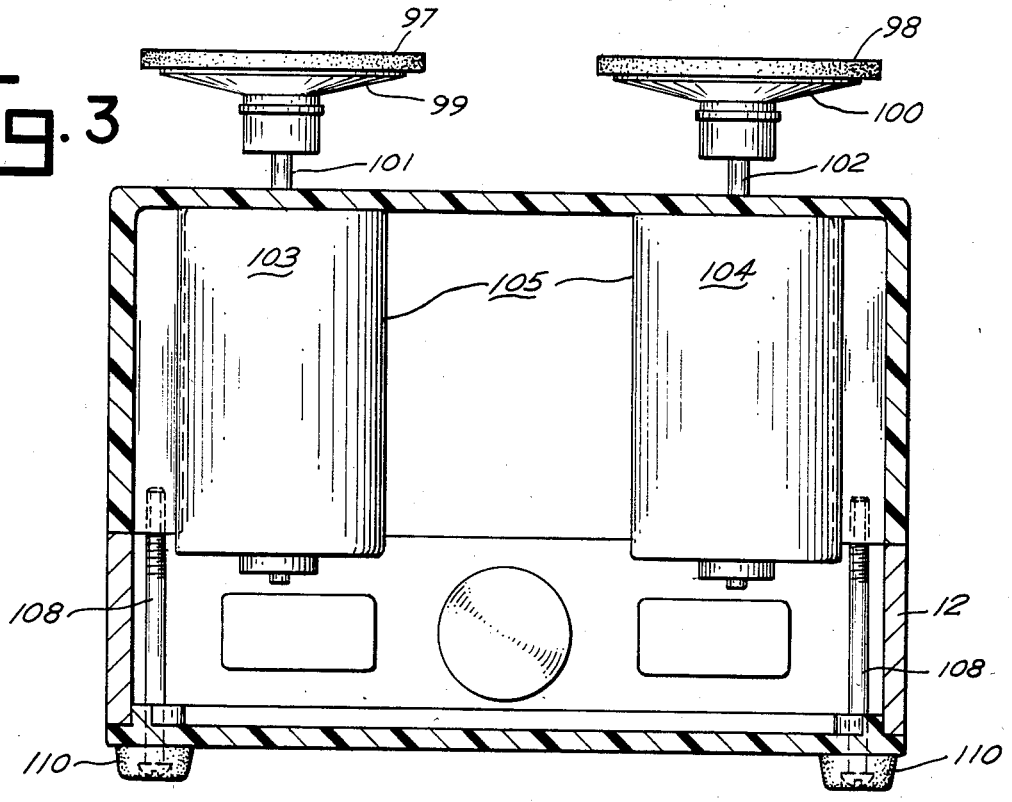
FIG. 3 is an enlarged cross-sectional view illustrating the motors for the disks, with the controls being shown in box form, the section being taken on line 3—3 of FIG. 2.

Switch 40 is used to activate the carriage member, and handle or knob 42 is rotated to adjust the speed of reciprocation to an optimum level for honing the particular knife blade. The vise and the mounted knife are moved back and forth in the track by the technician, as shown in FIG. 2, during reciprocation of the hone, to assure uniform honing. When one side of the knife has been honed, the instrument is switched off and the knife is raised by pivoting support 88 away from the hone. Vise 44 is then rotated 180° for honing the opposite side of the knife and the above detailed procedure is repeated. The rapid reciprocation of the hone, and the side-to-side movement of the knife in the track 92, provide complete and even honing of the knife in minimal time.

When honing has been completed, the knife must then normally be deburred or stropped to provide the desired finish to the edge. The normal procedure is to insert a conventional, elongataed knife handle (not shown) into a threaded slot 112 in the knife, shown here in FIG. 7. This can be done with the knife secured within vise 44, so that the technician does not have to handle the knife. The knife is then removed from the vise by loosening wheel 80, which allows separation of jaws 46 and 48. Switch 106 is used to activate motor means 105, which rotate the disks 97 and 98. The edge of the knife to be stropped is then held against the rotating disk with the edge pointing in the direction of rotation, so that the disk rubs against, and not into, the knife edge. Thus, as viewed in FIG. 1, the disk on the left side would be used to strop the knife with the sharpened edge closest to the outside of the instrument. Were the edge pointed in the opposite direction, it would be likely to cut into or catch on the disk, possibly causing injury to the technician. After stropping one side of the knife, it is turned over and the oppositely rotating disk is used for stropping the other side of the knife. The rapidly rotating disks accomplish the stropping operation in minimal time and the knife is then ready for tissue sectioning.

While one embodiment of my microtome sharpening instrument has been shown and described in detail herein, various changes and modifications may be made without departing from the scope of the present invention.

I claim:

1. An instrument for sharpening microtome knives and similar articles, comprising a reciprocating carriage member, a honing means rigidly secured to said carriage member and having a honing surface for honing the knife blade, a first motor means for moving said carriage member back and forth, a clamping means for holding the knife on said honing means, a mounting means for said clamping means, including a track disposed along one side of said honing means on a plane parallel with said honing surface and having an upwardly facing surface, of approximately semicircular cross-section, a base member having a downwardly facing surface of approximately semicircular cross-section seated on said upwardly facing surface and being pivotally mounted on said track for parallel and angular movement relative to said track for raising and lowering the blade relative to said honing means, and a pivot means connecting said clamping means to said base member for rotating the blade when in a raised position, a pair of counter-rotating shafts, a deburring means secured to each of said shafts, and a second motor means for driving said shafts.

2. An instrument for sharpening microtome knives and similar articles as defined in claim 1 in which a housing encloses said first and second motor means, and a support member is mounted on said housing for slidably receiving said carriage member.

3. An instrument for sharpening microtome knives and similar articles as defined in claim 2 in which said honing means includes a hone, and a shield means is removably mounted on said support member for shielding said hone during the honing operation.

4. An instrument for sharpening microtome knives and similar articles as defined in claim 3 in which said first motor means includes a variable speed control means and a manual control handle therefor.

5. An instrument for sharpening microtome knives and similar articles as defined in claim 1 in which said base member has a cylindrical slide for engagement with said track, and said track has a cylindrical channel receiving said slide and supporting said base member for slidable motion transverse to the motion of said honing means, said track having open ends for selectively receiving said base member.

6. An instrument for sharpening microtome knives and similar articles as defined in claim 5 in which said clamping means includes a rotatable vise for turning and honing each side of the knife, and said base member is pivotable between a first position in which the knife is disposed against said honing means and a raised position in which the knife can be rotated endwise, and said vise includes a tightening means for securing the knife.

7. An instrument for sharpening microtome knives and similar articles as defined in claim 6 in which a pivotable guard means is disposed at each of said ends of said track for selectively preventing said base member from leaving said track.

8. An instrument for sharpening microtome knives and similar articles as defined in claim 1 in which a platform for holding said honing means is mounted on and disposed perpendicular to said carriage member, and said second motor means includes a separate motor for each of said shafts.

9. An instrument for sharpening microtome knives and similar articles as defined in claim 1 in which a housing encloses said first and second motor means.

10. An instrument for sharpening microtome knives and similar articles as defined in claim 9 in which said shafts project vertically upwardly from said housing in spaced parallel relation and have free upper ends, and said deburring means includes disk shaped backing members secured to said upper ends of said shafts, said backing members having leather disks secured thereto for stropping the knife edge.

11. An instrument for sharpening microtome knives and similar articles comprising, in combination, a reciprocating carriage member, a hone having a honing surface and being mounted on said carriage member for movement therewith, a clampaing means for holding the knife on said hone, a mounting means disposed perpendicular to said carriage member for holding said clamping means and directing the knife blade against said hone, said mounting means including a track disposed along one side of said hone on a plane parallel with said honing surface, a base member pivotally mounted on said track for axial and angular movement relative to said track for raising and lowering the blade relative to said hone, a pivot means connecting said clamping means to said base member for rotating the blade when in a raised position, and a motor for moving said carriage member, said base member having a cylindrical slide for engagement with said track, and said track being disposed parallel with said hone and having a cylindrical channel receiving said slide and slidably mounting said base member, said track having an open end for receiving said base member.

12. An instrument for sharpening microtome knives and similar articles as defined in claim 11 in which the instrument includes a pair of parallel shafts for supporting stropping means, a motor means and a housing enclosing said motor means, said motor means including said first motor for driving said carriage member, a second motor for driving one of said shafts, and a third motor for driving the other of said shafts, and control means are provided on said housing for controlling the operation of said motors.

13. An instrument for sharpening microtome kinves and similar articles as defined in claim 12 in which an elongated support member is mounted on said housing in parallel relationship with said carriage member for slidably receiving said carriage member, and said hone is elongated and mounted perpendicular to said support member.

14. An instrument for sharpening microtome knives and similar articles as defined in claim 11 in which said clamping means includes a rotatable vise for honing each side of the knife, and said base member is pivotable between a first position in which the knife is disposed against said hone and a raised position for rotating the knife endwise, and said vise includes a tightening means for securing the knife.

15. An instrument for sharpening microtome knives and similar articles as defined in claim 14 in which a pivotable guard means is disposed at said open end of said track for preventing said base member from leaving said track.

* * * * *